United States Patent [19]

Herwood

[11] Patent Number: 4,580,667

[45] Date of Patent: Apr. 8, 1986

[54] PACKING SYSTEM

[76] Inventor: Betty K. Herwood, 5440 Lindley Ave. #106, Encino, Calif. 91316

[21] Appl. No.: 690,418

[22] Filed: Jan. 10, 1985

Related U.S. Application Data

[63] Continuation of Ser. No. 390,187, Jun. 21, 1982, abandoned.

[51] Int. Cl.[4] ..... A45C 13/02; B65D 33/14; B65D 30/06; B65D 30/22

[52] U.S. Cl. ..... 190/110; 190/100; 190/108; 150/113; 383/23; 383/39; 383/117

[58] Field of Search ..... 206/287.1; 190/100, 190/102, 110, 108, 40; 150/113; 383/23, 39, 117

[56] References Cited

U.S. PATENT DOCUMENTS

| | | | |
|---|---|---|---|
| 2,288,996 | 7/1942 | Dubilier | 383/117 X |
| 2,602,482 | 7/1952 | Lyon | 383/117 X |
| 2,979,098 | 4/1961 | Greaves | 383/37 X |
| 3,967,666 | 7/1976 | Farrar | 383/39 X |
| 3,980,116 | 9/1976 | Edwards | 150/113 |
| 4,156,446 | 5/1979 | Nathan | 383/117 X |
| 4,161,201 | 7/1979 | Carp | 190/110 |

*Primary Examiner*—William Price
*Assistant Examiner*—Sue A. Weaver
*Attorney, Agent, or Firm*—Sheldon & Mak

[57] ABSTRACT

An insert (10) for organizing contents of a piece of luggage or purse or wallet (76) is formed of a backing sheet (12) joined at its common side edges (16, 18) and bottom edge (20) to a front sheet (14) to form an upwardly-facing, storage pocket (22). The bottom edge (20) also carries at least one, preferably two, hinging assemblies (24) formed of a loop (50) to which is clipped by means of metal or plastic clip (54) to loops (50) on the bottom edge of other inserts (10) to form a loose-leaf assembly (75) or (78) or the clip (54) may be joined to loops (28) on the top edge of other inserts to form stringed, hanging assemblies (80). The insert may contain a hook (30) and stiffener (32) or these functions can be provided by a hanger (206) inserted into the rear pocket (202).

2 Claims, 7 Drawing Figures

PACKING SYSTEM

This application is a continuation of application Ser. No. 390,187, filed June 21, 1982, now abandoned.

DESCRIPTION

1. Technical Field

This invention relates to a packing system and, more particularly, to a separable, packing and organization system for clothing and accessories to be packed in a suitcase or cosmetics, jewelry and other items carried in a purse or handbag or money, credit cards or checks etc. carried in a wallet, or toilet articles for personal grooming or gym lockers.

2. Background Art

Suitcases and purses provide few pockets or sleeves for holding items. Otherwise, they provide one or more large compartments in which all other things to be carried are stored, all mixed together. It is difficult to find individual items within the jumble of other items in the dark compartment. Sometimes the whole compartment must be emptied to locate a single item.

Unpacking a typical suitcase is a chore especially during a customs inspection or during a trip where you are constantly changing location every few days. It is difficult to maintain clothing in a neat, pressed condition in the open, loose environment of a suitcase compartment.

The problem with disorganized packing has been recognized and certain devices have been developed to alleviate this burden, especially with purses. Conwiser (U.S. Pat. No. 2,529,724) discloses a pleated, multiple compartment kit for carrying purse contents so that they can be readily moved from purse to purse. A transparent, foldable glove case is described in U.S. Pat. No. 1,541,563. The purse kit shown by McNary (U.S. Pat. No. 2,183,428) has straps stitched at various locations to provide sleeves for holding cosmetics and grooming aids such as combs, brushes, etc. Credit card holders insertable into wallets or purses such as those shown in U.S. Pat. No. 2,732,875 are widely utilized.

Some overnight bags provide better separation and specific compartments for packing clothing such as U.S. Pat. No. 2,686,580. A garment pack that can be inserted and removed from luggage is disclosed in U.S. Pat. No. 3,570,570. However, only one compartment for receiving clothing is formed by means of an adjustable frame having an outer wrapping with flaps which tie around the frame.

DISCLOSURE OF INVENTION

A totally versatile packing system is provided in accordance with this invention. The system is based on thin-wall packing inserts that can be releasably hinged along their lower edges into a rotatable assembly. Thus, the inserts can be turned like pages to reach a certain insert and remove a single item without disturbing anything else packed in the luggage or in any other page. A single page can be utilized for an overnight trip or a plurality of pages can be hinged together to form an assembly for the larger packing capacity needed for weekend trips or for extended journeys. The assembly fits into most pieces of luggage. The hinged pages can be packed in closed book configuration or in an open book configuration. Individual pages can be separated and packed throughout the luggage as dividers to separate items of clothing and keep them from shifting and wrinkling. Separation of the inserts also makes items easier to locate and remove one-at-a-time without disturbing the rest of the contents of the luggage. The inserts may have varied sleeve configurations adapted to store a wide variety of clothing accessories, and items.

The rotatable assembly of hinged elements can also be packed into the bottom portion of a garment bag, a space usually wasted. One or more elements can be hung at the top of a garment bag or several pages can be clipped together, joining bottom edge to top edge of the next page, and the string of pages can be hung in a garment bag or in a closet. By using the pages to pack small items of clothing and personal care items, a traveller can get by with a garment bag eliminating the need to carry and handle a separate piece of luggage.

When a traveller arrives in his hotel room he has the option of leaving the packed page elements in his luggage, placing them intact in drawers in furniture or hanging one or more pages on hangers in the closet.

The packing system of the invention is based on a packing element in the form of a page which is constructed as a thin-wall member having upwardly facing pockets and sleeves. Each page contains along the bottom edge a plurality of attachment means for releasably hinging the bottom edges of the pages into a loose-leaf assembly of pages such that any page can be accessed by flipping the pages. The pages may also be provided with fastening means on the top edges which can be joined to the hinges to form a vertical assembly. The top page in a vertical assembly or any of the pages can be provided with a hanger and stiffener, if required, for hanging the assembly in a closet or a garment bag.

These and many other features and attendant advantages of the invention will become apparent as the invention becomes better understood by reference to the following detailed description when considered in conjunction with the accompanying drawings.

DETAILED DESCRIPTION OF THE INVENTION

Figure 1:
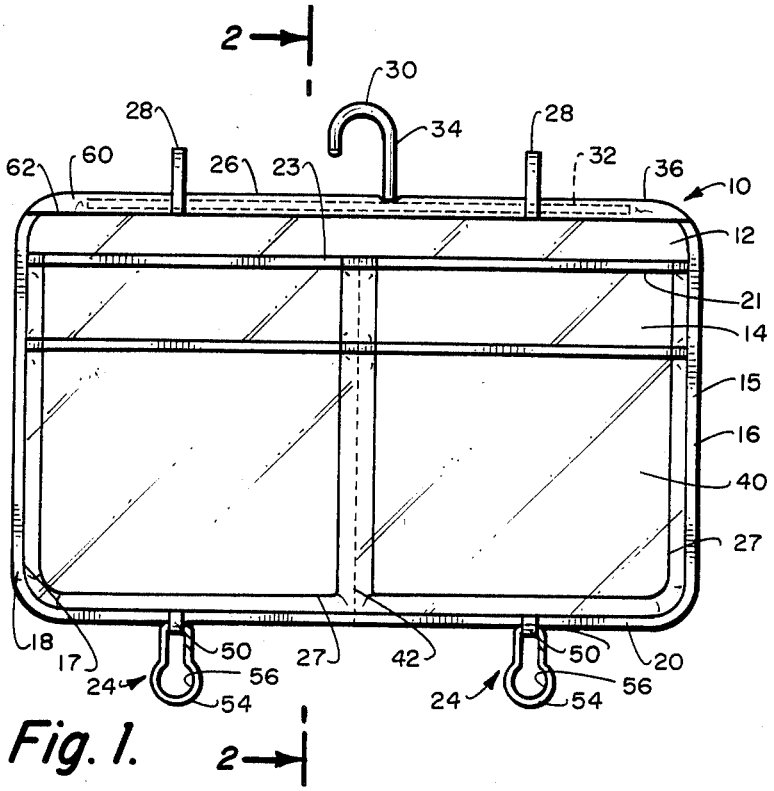
FIG. 1 is a front view in elevation of a first embodiment of a packing page element in accordance with the invention.
Figure 2:
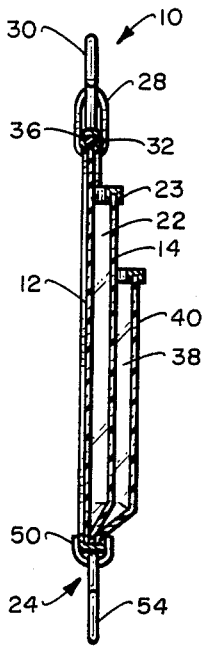
FIG. 2 is a view in section taken along line 2—2 of FIG. 1.

Referring now to FIGS. 1 and 2, the packing insert in the form of a page element 10 is a thin, flexible unit formed of a back sheet 12 and at least one front sheet 14 joined together along three common edges comprising side edges 16, 18 and bottom edge 20 such as by stitching the edges of the sheets 12, 14 while inserted into a length of bias tape 15 to form a reinforced border 17. The upper edge 21 of the front sheet 14 also contains a reinforced border 23 along the entrance to a top opening pocket 22. At least one, preferably two rotatable, releasable assemblies 24 are secured to the bottom edge 20.

Figure 4:
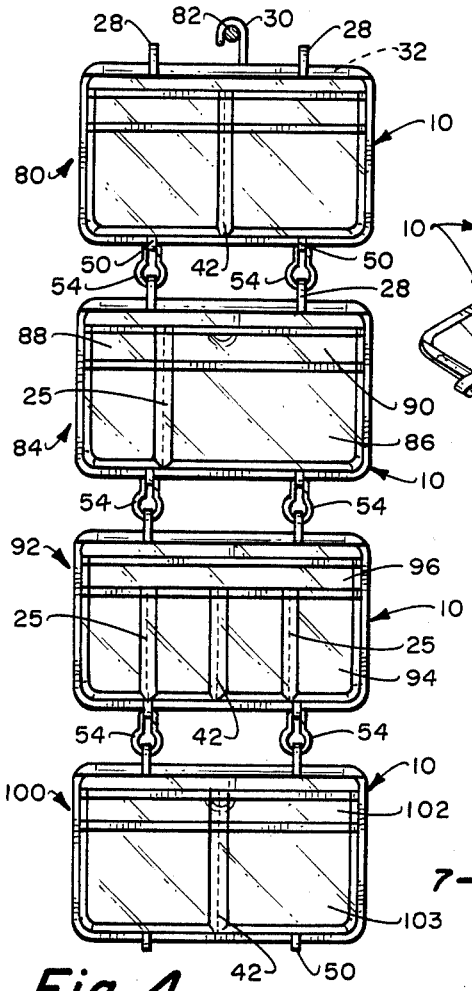
FIG. 4 is a front elevation view of a plurality of page elements clipped together to form a string assembly suspended from a closet rod.

Optionally, the top edge 26 may be provided with fastening means such as loops 28 for use in forming hanging assemblies. The uppermost page 10 in a hanging assembly is provided with a hook 30. A stiffening rod 32 attached to the shaft 34 of the hook 30 must be provided if any amount of weight is to be carried by the uppermost page 10. A further pocket 38 can be provided on the back surface, or, as illustrated on the front surface, by securing a further sheet 40 to the common welted border 17 as described. The pocket 38 and/or the pocket 22 can be divided into smaller compartments by a vertical stitch 42, as shown, or by further vertical stitches 25 as shown in FIG. 4. The storage capacity of the pockets can be increased by using a front sheet having a width greater than the back sheet. The excess flexible material can form pleats 27.

The packing element 10 can be manufactured in various configurations such as square, hexagonal, rectangular, etc. It is preferred to utilize rectangular shapes since that shape is most adaptable to luggage or purses which are usually rectangular. The elements will usually be longer than they are high, typically for luggage from 12 inches to 30 inches long and 6 to 18 inches high, usually 14×20 inches for luggage and 4×6 inches for wallets or purses. The sheet can be formed of various flexible materials and can be opaque, translucent or transparent. It is preferred to use transparent materials so that items can be readily located and contents are visible to a customs inspector avoiding unpacking the luggage. The transparent sheet can be a plastic such as vinyl, polyethelene or polypropylene or a sheet of netting. The latter can provide ventilation to the clothing. Thermoplastic materials can be edge bonded by thermal fusion or by means of adhesives.

The rotatable, releasable assemblies 24 can be formed from numerous mechanical elements. In its simplest form, one or more attachment elements such as loops 50 are secured to the bottom edge of each element. The loops 50 can be tied together with a piece of string, ribbon or other material. As shown the loops 50 are attached to a releasable hinging means such as a metal clip ring 54 having an opening 56 for receiving one or more loops 50. The clip ring 54 lies in a plane perpendicular to the loops 50 and acts as a releasable hinging element as in a loose-leaf ring binder.

Figure 5:
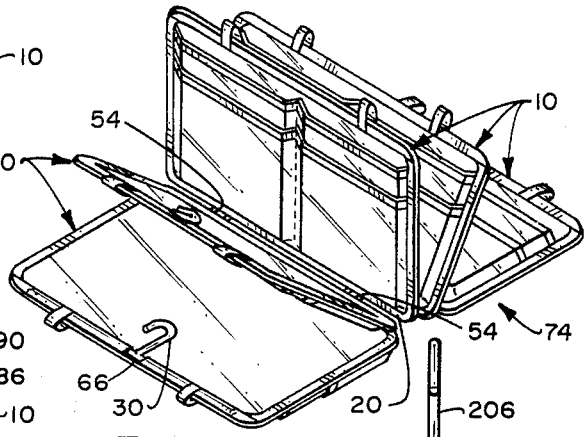
FIG. 5 is a perspective view of the page elements hinged along their bottom edges.

The fastening loops 28 attached to the top edge 26 should be in vertical alignment with the loops 50 so that they can be clipped onto clip ring 54 without distorting the page element. The fabric reinforcement tape 60 used for the top edge 26 can be wider to form a sleeve 36 for receiving the stiffening rod 32. The tap 60 is stitched along horizontal line 62 below the rod 32. The sleeve 36 has a vertical slot 66 as shown in FIG. 5 such that the hanger can be rotated downwardly below the top edge 26 so that it is out of the way. The intersections of the top tape 60 and bottom tape 20 with the side tapes 16,18 may be reinforced by gussets as may any other area of the packing insert requiring reinforcement.

Other suggested attachment and hinging devices are snap closure rings such as used for loose-leaf papers, plastic or fabric belt strips having snap closures, Velcro ends, buckle ends, turn-buckle ends or D-rings. All that is required is that the device releasably join with the loop or ring at the bottom edge and permit rotation of the elements so that each pocket is accessible.

Figure 3:
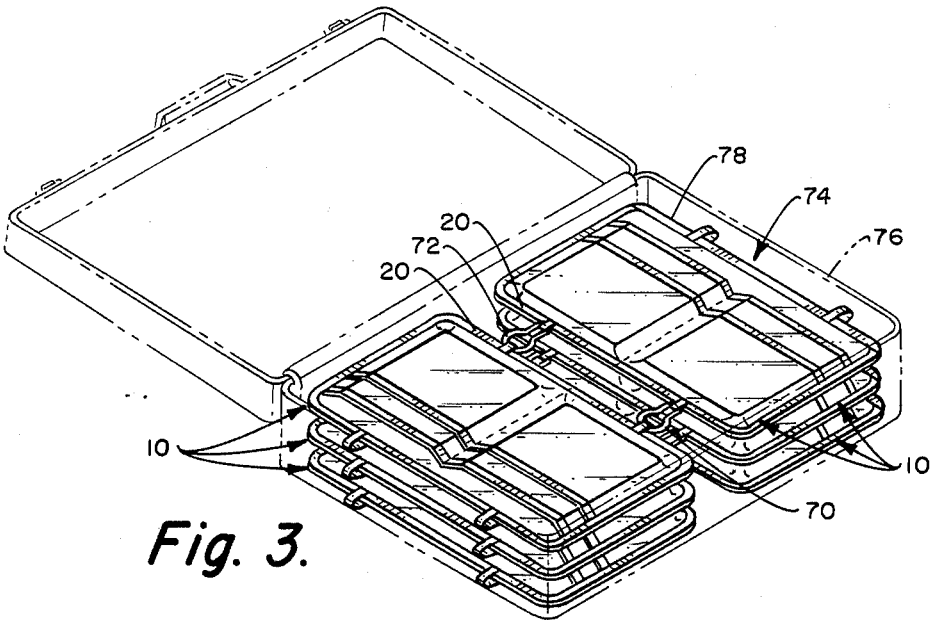
FIG. 3 is a perspective view of a plurality of hinged packing elements shown in open book configuration within a piece of luggage.

Referring now to FIGS. 3 and 5, a plurality of elements 10 are releasably and hingedly joined at their bottom edges 20 to form a loose-leaf system 74 by means of a set of two clip rings 70, 72 attached to each loops 50 on respective sides of the stacked elements. The loose leaf system 74 is placed inside a piece of luggage such as a suitcase 76. The elements 10 can all be clipped in the same direction or half can be clipped in opposite directions to the other half in the open book configuration 78 as shown in FIG. 3. The elements are shown in closed book configuration in FIG. 5 with the elements rotated open for better display.

FIG. 4 illustrates a string 80 of elements 10 hung with the bottom edge 20 clipped to top edge of the next page element 10. The top element contains a hanging means such as hanger hook 30 placed on a closet pole 82. The clip ring 54 is utilized to connect the elements by clipping to the loops 28 on the top edge of the next element.

The assembly also illustrates various pocket configurations. The top element 10 contains double pockets further subdivided into double pockets as illustrated in FIG. 1. This element is suitable for underwear, nightwear, shirts, or tee shirts. The next element 84 has a single front pocket 86 which can be used to pack dresses, slacks, sweaters etc. and the rear pocket is divided one/third and two/thirds to form a small pocket 88 suitable for belts, ties, scarves, etc., and a larger 90 pocket suitable for blouses. Element 92 has three small front pockets 94 for lingerie and one large rear pocket 96 for swimwear. Element 100 has one large rear pocket 102 and a large undivided front pocket 103 for robes and pajamas. Numerous other combinations are possible. The traveller need only purchase page elements suitable for his/her wardrobe for the particular trip involved. They may be sold in sets of pages or purchased separately as needed.

Figure 7:
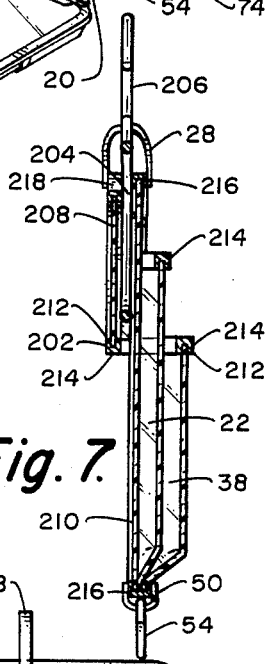
FIG. 7 is a view in section taken along line 7—7 of FIG. 6.
Figure 6:
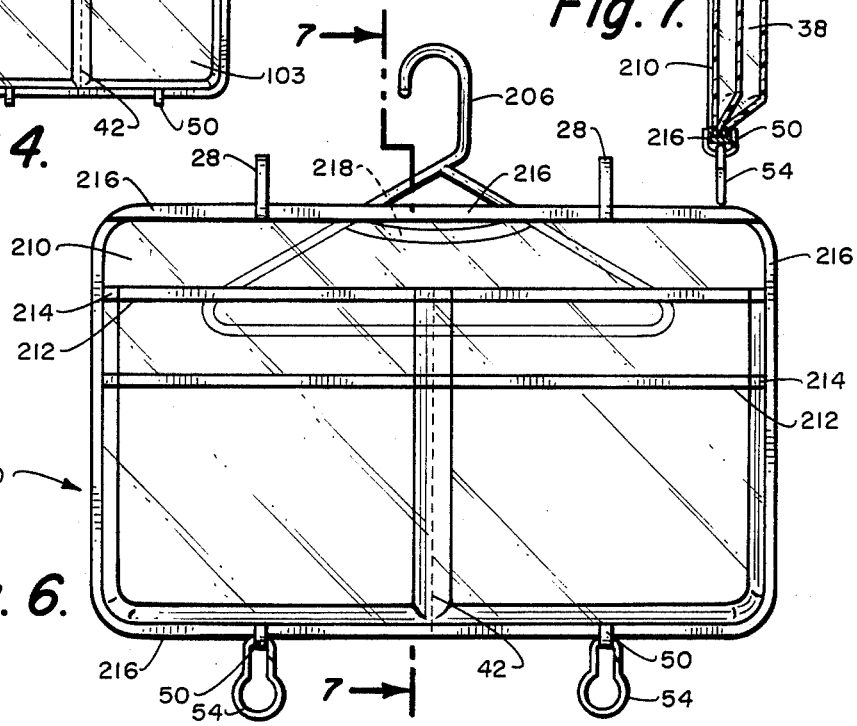
FIG. 6 is a front view in elevation of another embodiment of a packing element.

A further embodiment of a packing element is illustrated in FIGS. 6 and 7. The element 200 can have the same front configuration, bottom hinging assemblies 54 and top loops 28 and pockets 22 and 38 as the elements previously described. However, the hanging means for the uppermost element in a string comprises a rear sleeve 202 having a central opening 204 for receiving a conventional hanger 206. The sleeve is formed of a sheet 208 of flexible material such as the transparent or web materials previously described. The sheet need not be coextensive with the rear sheet 210 of the element. A length just exceeding the length of a hanger is sufficient. The lower edge 212 may be finished and/or reinforced with tape 214. All other edges are incorporated into the common reinforced edge and top seams 216 except for the curved portion 218 at the opening 204.

The elements can also be attached to hangers by clipping the upper loops to a skirt hanger or sliding the loops over the rod of a pants hanger. The loops on the top edge can be lengthened and slipped onto the sloped side arms of a shoulder hanger and tightened in place with a slip-lock tightener such as used on various straps. The hanging structure can also be a simple central loop slipped over the shaft of a hanger or hung on a hook. Another method of providing a method of carrying, stiffening and/or handling a packing element is to secure a stiff plastic member having a central carrying handle to the upper edge of the back sheet. Similar structure is utilized on certain plastic shopping bags.

The front sheet may carry fasteners such as snaps or ties to close the pockets.

It is to be realized that only preferred embodiments of the invention have been described and that numerous substitutions, modifications and alterations are permissible without departing from the spirit and scope of the invention as defined in the following claims.

I claim:

1. A packing system comprising:

(a) a least three thin wall packing inserts, each insert comprising a flexible, transparent backing sheet formed of netting, a transparent flexible intermediate sheet, and a transparent flexible front sheet, the three sheets having top, bottom, and side edges, the sheets being joined together at their bottom and side edges to form at least one upwardly facing intermediate pocket between the backing sheet and the intermediate sheet and at least one upwardly facing top pocket between the intermediate sheet and the front sheet, wherein the top edge of the intermediate sheet is below the top edge of the backing sheet and the top edge of the front sheet is below the top edge of the intermediate sheet for easy access to the pockets, the width of the front sheet being greater than the width of the backing sheet, the front sheet having at least one pleat;

(b) at least two attachment elements provided on the bottom edge of each insert in substantially the same position on each insert;

(c) the same number of independent, separate releasable hinging means as the number of attachment elements on each insert, the hinging means being connected to the attachment elements for connecting the inserts into a rotatable assembly so that each insert can be rotated along its lower hinged edge away from the adjacent insert so that each pocket is accessible from the top edge of the assembly;

(d) a sleeve attached on one of the inserts, the sleeve having a top opening adjusted to receive a conventional clothes hanger for hanging the packing system; and (e) divider means for dividing the top pocket of at least one of the inserts into smaller pockets.

2. The packing system of claim 1 in which the divider means comprises vertical stitches holding the three sheets of one of the inserts together for dividing both the intermediate and top pockets into smaller pockets.

* * * * *